United States Patent [19]

Pennestri

[11] Patent Number: 4,995,536

[45] Date of Patent: Feb. 26, 1991

[54] SEWING NEEDLE WITH A THREADING ASSISTING FEATURE

[76] Inventor: Domenick Pennestri, 86 Mayloft Ct., Huntington Station, N.Y. 11746

[21] Appl. No.: 422,512

[22] Filed: Oct. 17, 1989

[51] Int. Cl.[5] ..... D05B 87/00; D05B 85/00

[52] U.S. Cl. ..... 223/102; 112/222

[58] Field of Search ..... 223/102; 112/222; 606/222, 223

[56] References Cited

U.S. PATENT DOCUMENTS 3,525,460 8/1970 Hendy ..... 223/102

FOREIGN PATENT DOCUMENTS 588609 5/1925 France ..... 223/102
517912 3/1955 Italy ..... 223/102
112875 1/1918 United Kingdom ..... 223/102

*Primary Examiner*—Werner H. Schroeder
*Assistant Examiner*—Bibhu Mohanty
*Attorney, Agent, or Firm*—Terry M. Gernstein

[57] ABSTRACT

A self-threading needle includes a slot extending from the outer surface into the eye of the needle that is continuous and uninterrupted for the entire length thereof. The slot is highly angled so that the thread, once in the eye, is not likely to exit that eye via the slot. The slot includes various wall shapes, such as curved, straight or compound.

1 Claim, 2 Drawing Sheets

SEWING NEEDLE WITH A THREADING ASSISTING FEATURE

TECHNICAL FIELD OF THE INVENTION

The present invention relates to the general art of sewing, and to the particular field of sewing needles.

BACKGROUND OF THE INVENTION

The art of sewing has included many forms of needles from complex needles used in sophisticated machines to simple bone needles.

All sewing needles, no matter how simple or complex, have a common feature, to wit: they must be threaded. Threading a needle can be a difficult task to perform by hand for anyone, but is especially difficult for an elderly person or a person whose manual dexterity or whose hand-eye co-ordination may be impaired.

For this reason, the art has included several proposals for self-threading needles, see for example, the needles disclosed in U.S. Pats. Nos. 3,531,030 and 4,385,575. While somewhat successful, these self-threading needles still have several drawbacks. For example, some of these known needles require the thread to be forced past a closed passage. This may, in some instances, tend to fray the thread, and may even weaken such thread. In some cases, it may even cause the thread to break. Another problem with the closed-passage type self-threading needle is that the degree of manual dexterity that is required may be higher than desirable.

Therefore, there is a need for a self-threading needle which can be easily used and which will not unduly expose the sewing thread to the possibility of becoming frayed, weakened or broken during the movement thereof into the eye of the needle.

OBJECTS OF THE INVENTION

It is a main object of the present invention to provide a self-threading needle which can be easily used.

It is another object of the present invention to provide a self-threading needle which can be easily used and which will not unduly expose the sewing thread to the possibility of becoming frayed, weakened or broken during the movement thereof into the eye of the needle.

SUMMARY OF THE INVENTION

These, and other, objects are achieved by a needle with a slot that is shaped to permit easy entry of the thread into the eye of the needle, but which also includes an open exit section whereby the thread does not have to force apart any elements to move into the eye of the needle.

The slot is shaped and sized so that the thread easily fits thereinto, moves easily therethrough, and easily exits therefrom without being required to move past closed elements. Yet the slot is sized and shaped so that, once through the eye, the thread is not likely to pass back through the slot and out of the eye.

DETAILED DESCRIPTION OF THE PREFERRED EMBODIMENT OF THE INVENTION

Figures 1, 2:
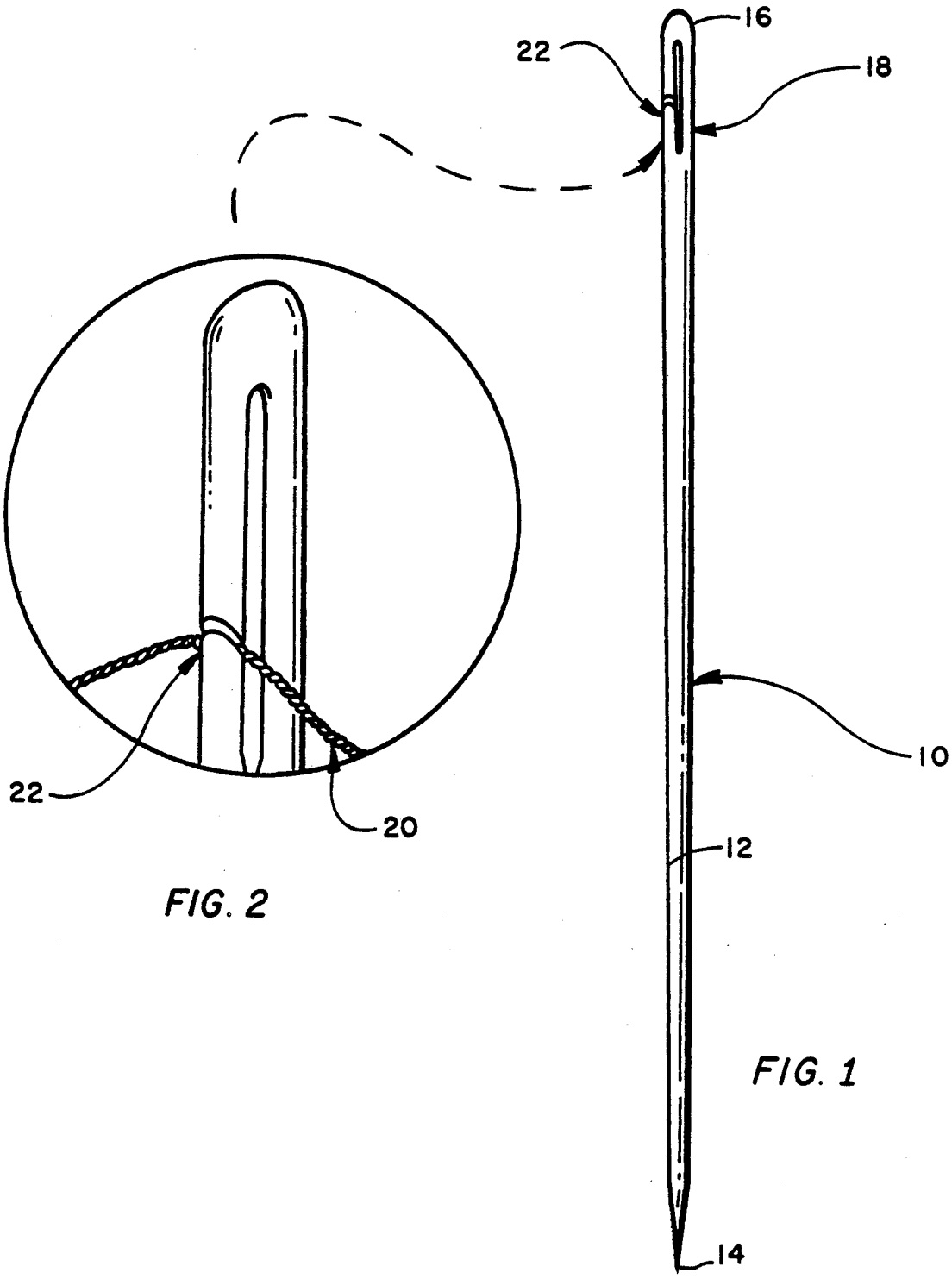
FIG. 1 is a perspective view of a needle having a self-threading slot according to the present invention.
FIG. 2 is a perspective of the needle portion adjacent to the slot of the present invention.

Shown in FIGS. 1 and 2 is a needle 10 embodying the present invention and having a body 12 with a point 14 on one end thereof and a head 15 on the other end thereof. The needle includes an eye 18 defined in the body adjacent to the head and through which thread, such as sewing thread 20, is passed to attach such thread to the needle for sewing.

The needle 10 includes a slot 22 leading from outer surface 24 of the body into the eye 18. The slot is angled and forms a continuous and uninterrupted passage from the outer surface of the body into the eye so that there are no edges for the sewing thread to catch onto. This reduces the possibility of the thread becoming frayed or weekend as it is being moved into the eye 18.

Figure 3:
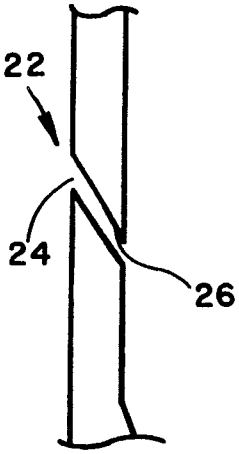
FIG. 3 is an elevational view showing an enlargement of the needle portion adjacent to the slot of the present invention.

Referring to FIG. 3, it can be seen that the slot 22 is wider at an entrance section 24 than it is at an exit section 26. The slot is sharply angled from the head towards the point so that the thread is not likely to return into the slot once it has been located in the eye. The slot is continuous and uninterrupted from the entrance section to the exit section and converges toward the exit section so that exit section is smaller than the entrance section.

Figure 6:
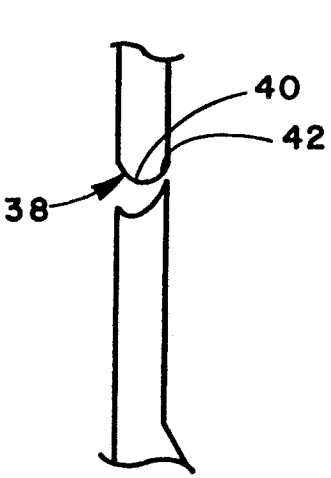
FIG. 6 is an elevational view of an alternative embodiment of the needle portion adjacent to the slot of the present invention.
Figure 5:
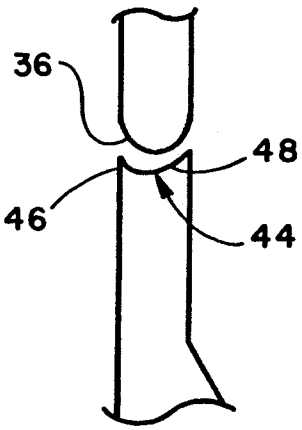
FIG. 5 is an elevational view of an alternative embodiment of the needle portion adjacent to the slot of the present invention.
Figure 4:
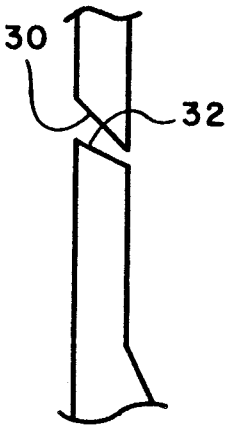
FIG. 4 is an elevational view of an alternative embodiment of the needle portion adjacent to the slot of the present invention.

Other forms of the passage are shown in FIGS. 4–6 and all are continuous and uninterrupted from the entrance section to the exit section thereof. Thus, the passage can include two straight walls, as shown in FIG. 4, with one wall 30 of the two walls being sloped to a much greater degree than the other wall 32 of the two walls. The slot can include a wall that is entirely curved as indicated in FIG. 5 at top wall 36, or can include a wall that is partly curved and partly straight as shown in FIG. 6 for wall 38 which includes curved section 40 and straight section 42, or a wall such as bottom wall 44 that is a compound curve having a first curved portion 46 and a second curved portion 48. As shown in FIG. 6, the passage can include walls that are designed, either to be compound straight lines, compound curves or a combination thereof to have the exit section much smaller that the entrance section even though the exit section located above or near the level of the entrance section with respect to the needle point.

It is understood that while certain forms of the present invention have been illustrated and described herein, it is not to be limited to the specific forms or arrangements of parts described and shown.

I claim:

1. A sewing needle having a body with a point on one end and a head on another end and an eye located adjacent to the head and comprising:

(A) a body outer surface;

(B) a slot extending through said body from said body outer surface into the eye, said body having an inner surface adjacent to said eye, said slot (1) being continuous and uninterrupted from an entrance section located in said body outer surface to an exit section located in said inner surface in said eye, and (2) having said entrance section larger than said exit section;

(C) said body including a top wall adjacent to said slot and the needle head and a lower wall adjacent to said slot and below said top wall, said top and bottom walls being in confronting relationship with each other;

(D) said top wall being curved continuously from said outer surface to said inner surface with a single radius of curvature and being convex as viewed from said bottom wall; and (E) said bottom wall being curved from said outer wall to said inner wall and being concave as viewed from said top wall, said bottom wall including a first curved section and a second curved section with said first curved section intersecting said body outer surface and said second curved section intersecting said body inner surface adjacent to said eye, said first curved section being curved on a radius of curvature which is less than a radius of curvature of said second section, said first curved section intersecting said second curved section at a location that is between said inner surface and said outer surface, each of said bottom wall curved sections being curved to a different degree from each other and to a degree which is different from the curvature of said top wall.

* * * * *